United States Patent [19]

Jankowiak et al.

[11] Patent Number: 4,768,128

[45] Date of Patent: Aug. 30, 1988

[54] WATER ACTIVATED PRESSURIZED GAS RELEASE DEVICE

[75] Inventors: Roman Jankowiak, Cheektowaga, N.Y.; John A. Lutocka, Jr., Seminole, Fla.

[73] Assignee: Conax Florida Corporation, St. Petersburg, Fla.

[21] Appl. No.: 47,016

[22] Filed: May 5, 1987

Related U.S. Application Data

[63] Continuation-in-part of Ser. No. 817,026, Jan. 8, 1986, abandoned.

[51] Int. Cl.[4] ..... F23Q 7/02

[52] U.S. Cl. ..... 361/251; 441/96

[58] Field of Search ..... 361/251; 137/392; 441/92, 93, 94, 95, 96, 97; 222/5, 54; 102/202.9

[56] References Cited

U.S. PATENT DOCUMENTS

| | | | |
|---|---|---|---|
| 3,059,814 | 10/1962 | Poncel et al. | 441/94 X |
| 3,266,669 | 8/1966 | Vagosevich | 441/94 X |
| 3,815,783 | 6/1974 | Hirata | 441/94 X |
| 4,024,440 | 5/1977 | Miller | 361/251 |

*Primary Examiner*—L. T. Hix
*Assistant Examiner*—Brian W. Brown
*Attorney, Agent, or Firm*—Christel, Bean & Linihan

[57] ABSTRACT

An improved, low cost, water activated pressurized gas release device utilized for inflating flotation equipment, such as life jackets, when dumped into the water. The device includes a one piece die cast housing (12) formed of an electrically conductive material. All major components of the device are mounted within the housing with the exception of the container (14) of pressurized gas, a manual actuating device (18), and a battery housing (16). A portion of the housing or container acts as a first contact when immersed in an electrically conductive fluid. A battery (64) is disposed within the battery housing (16) which is in turn received within a battery bore (34) in the housing (12). The battery housing is provided with an exposed sensor plate (76) the inside of which is in electrical contact with the battery anode (74). The plate acts a second contact. An electrical circuit (62) is disposed within a cavity (36) in line with the battery, the electrical circuit being enclosed by a potting compound (80) which also serves to maintain a cover (82) in place over the cavity. The gas passageway between a transverse D-shaped hole (30) and a longitudinally extending piercing pin receiving bore (24) is formed by a keyway (32) parallel to the D-shaped hole and which intersects the D-shaped hole and the piercing pin receiving bore thereby reducing machining costs.

9 Claims, 2 Drawing Sheets

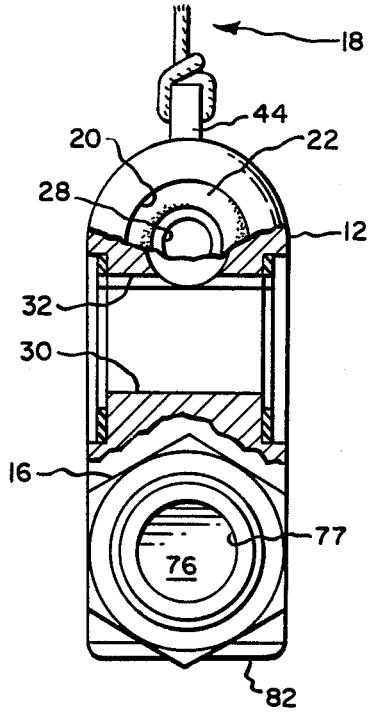
Fig. 3.
Fig. 4.
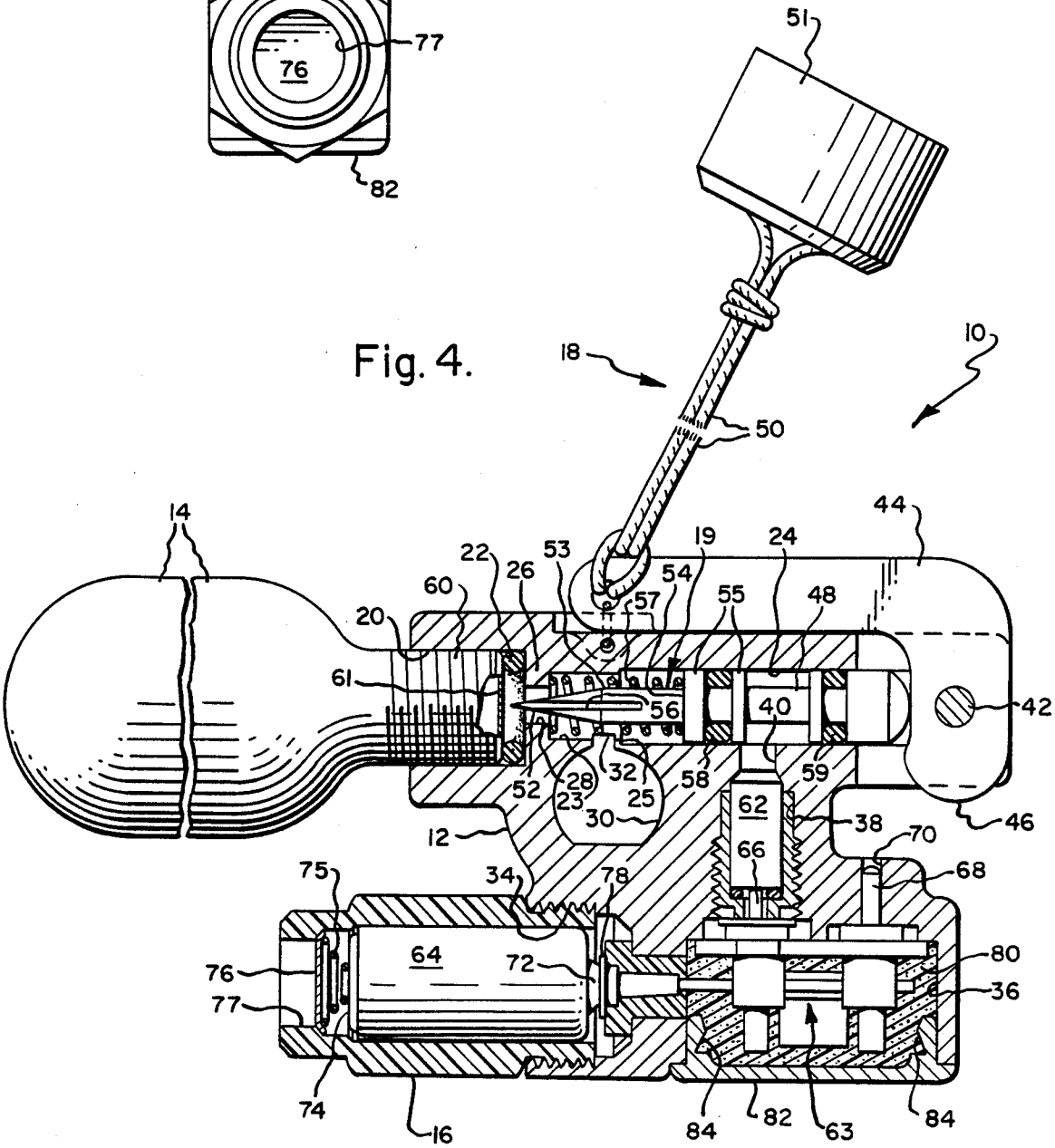

WATER ACTIVATED PRESSURIZED GAS RELEASE DEVICE

CROSS REFERENCE TO RELATED APPLICATIONS

The present application is a continuation-in-part of applicant's corresponding U.S. application Ser. No. 817,026, filed Jan. 8, 1986, now abandoned.

FIELD OF THE INVENTION

The present invention relates generally to water activated pressurized gas release devices utilized for inflating flotation equipment when dumped into the water, and more specifically to an improvement of the water activated pressurized gas release device of the type shown in U.S. Pat. No. 4,024,440 issued May 17, 1977, the subject matter of which is incorporated herein by reference thereto.

BACKGROUND OF THE INVENTION

Water activated pressurized gas release devices of the type shown in the aforementioned patent have been used in a very satisfactory manner by naval aviators, the purpose of the device being to inflate a pilot's life vest should he accidentally land in water after bailing out of an aircraft. Many seamen who work with the pilots are also desirous of having such devices made available to them in case they should inadvertently fall off the deck of an aircraft carrier or the like. Therefore, it is desirable that a water activated pressurized gas release device be developed which will serve the purposes of deck crew personnel of an aircraft carrier or the like.

OBJECTS AND SUMMARY OF THE INVENTION

It is an object of the present invention to provide a water activated pressurized gas release device of the type referred to which will be satisfactory for deck crew personnel of an aircraft carrier or the like, which device will be of a lower cost than prior art designs, which may be used again if manually operated but which may not be used again if operated by an explosive device, and which device may be used in areas generally considered hazardous to electro-explosive assemblies and also in area with explosive potential such as a refueling area.

The object set forth above are accomplished by providing a one piece die cast housing in which are mounted all major components of the water activated pressurized gas release device, with the exception of the container of pressurized gas, a manual actuating device, and a battery housing. A portion of the die cast housing or the pressurized gas container acts as a first contact when immersed in an electrically conductive fluid. A battery is disposed within the battery housing formed of polyethylene, which is in turn screwed into the die cast housing. A sensor contact assembly within the battery housing contacts the anode of the battery and is exposed, so that it may act as a second contact when the device is placed in an electrically conductive fluid. One of the major components is an electrical circuit which is disposed within a cavity in the die cast housing in line with the cathode of the battery, the electrical circuit being enclosed by a potting compound which also serves to maintain a cover in place over the cavity which receives the electrical circuit. The electrical circuit will ignite an explosive device when the housing is placed in water, the gases released by the explosive device driving a piercing pin, mounted in a piercing pin bore, through a pierceable closure in the container, releasing the gas within the container. In addition, a gas passageway is provided between the transverse D-shaped hole and the piercing pin receiving bore, the gas passageway being formed by a keyway parallel to the D-shaped hole and which intersects the D-shaped hole and the piercing pin bore thereby reducing machining costs.

The above objects and other objects and advantages of the present invention will be more fully understood after a consideration of the following detailed description taken in conjunction with the accompanying drawings in which a preferred form of this invention is illustrated.

BRIEF DESCRIPTION OF THE DRAWINGS

FIG. 3 is a partial sectional view of FIG. 2 taken from the left-hand side, the gas container not being shown for purposes of clarity.

FIG. 4 is a sectional view of the device shown in FIG. 2.

DETAILED DESCRIPTION

Figure 1:
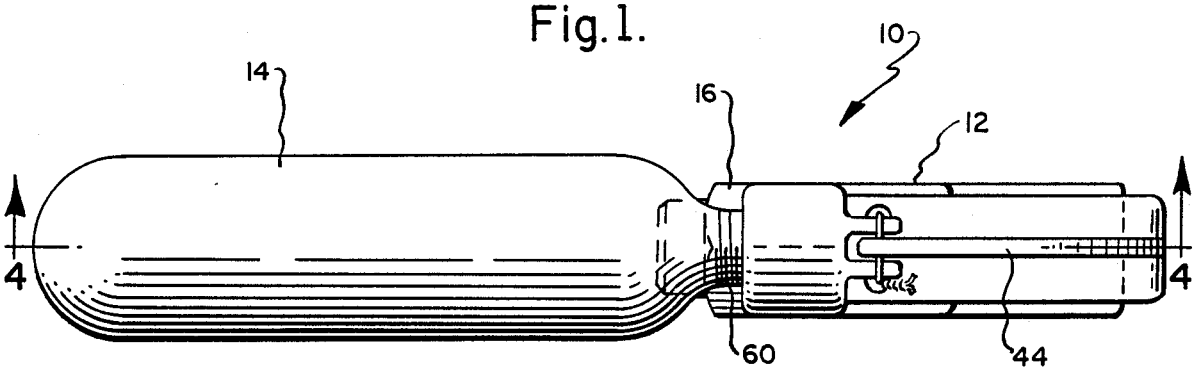
FIG. 1 is a top view of the device of this invention.
Figure 2:
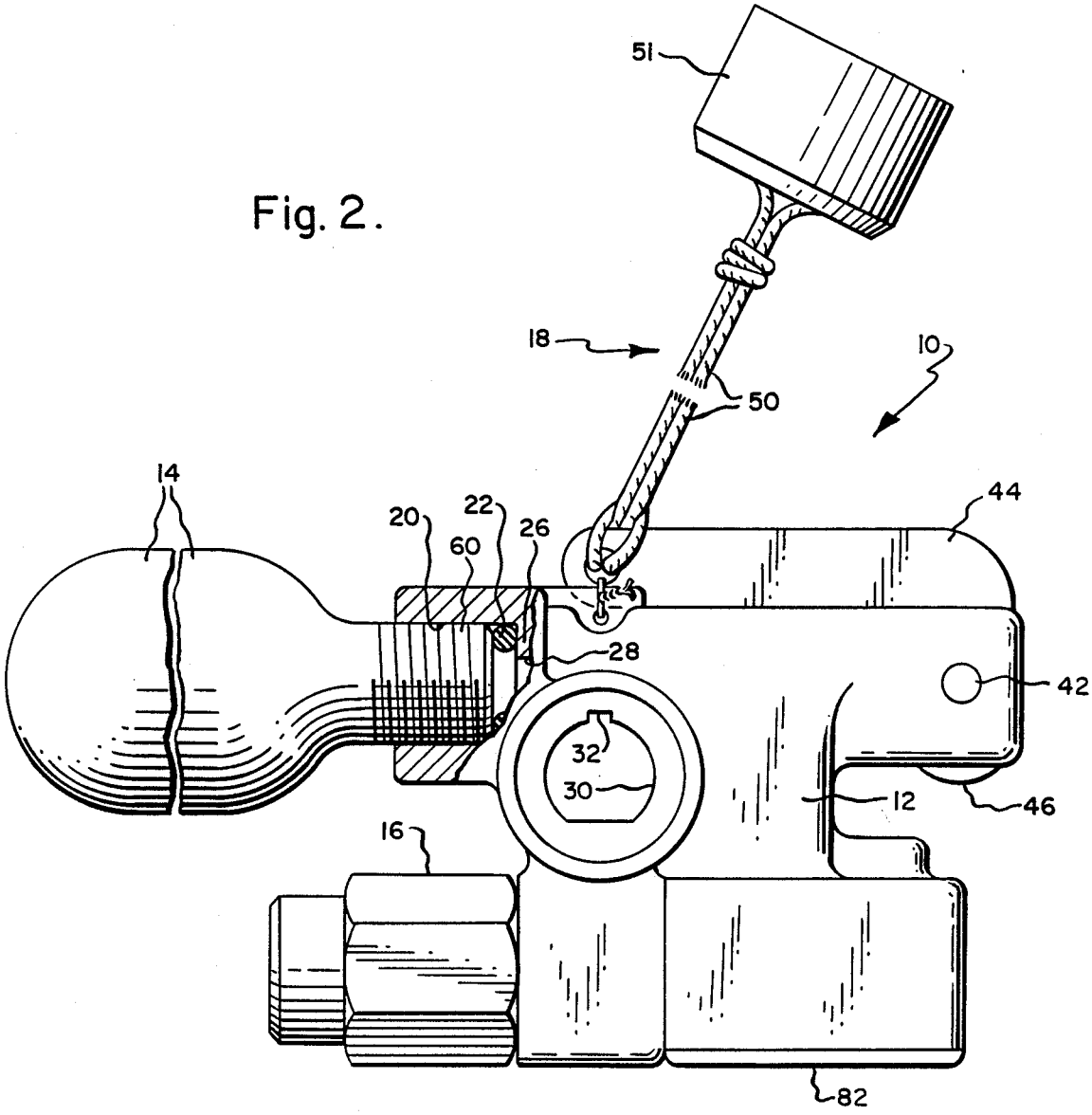
FIG. 2 is a side view of the device as shown in FIG. 1.

The improved water activated pressurized gas release device of this invention, which is indicated generally at 10, includes a one-piece die cast housing 12 formed of an electrically conductive material, which housing receives various components, a container 14 of pressurized gas, a battery housing 16, and manually engagable means 18. A piercing pin, indicated generally at 19 in FIG. 4, is mounted within the housing and is shiftable from the illustrated first or right-hand position to the left to a piercing position (not shown). The manually engagable means 18 is one form of shifting means which is capable of shifting the piercing pin 19 from its first position to a piercing position. Another form of shifting means is illustrated, this being an electrically operated explosive device which will cause the piercing pin to be shifted to another piercing position when the device is immersed in an electrically conductive fluid such as a lake or an ocean. For the purposes of this application, an electrically conductive fluid is defined having a conductance equal to or greater than 90 micromhos per centimeter.

Referring now in greater detail to FIG. 4, the housing 12 is provided with a longitudinally extending threaded bore 20 which is provided with a packing ring 22 at one end thereof. The housing is further provided with a cylindrical piercing pin receiving bore which is formed concentrically with the threaded bore 20. The bore has a reduced diameter left-hand portion 23 and a full diameter portion 24, there being a shoulder 25 between the two portions. The wall 26 between the threaded bore 20 and the piercing pin receiving bore 24 is provided with a cylindrical aperture 28 so that the piercing pin receiving bore is open to the threaded bore, the aperture 28 being concentric with bore 23, 24. A transverse D-shaped hole 30 is provided to one side of the piercing pin receiving bore, the D-shaped hole being adapted to receive a stem (not shown) on the article to be inflated such as a life vest or life raft. A gas passageway is formed between the transverse D-shaped hole and the longitudinally extending piercing pin receiving bore and, in accordance with one of the features of this invention, the gas passageway is in the form of a keyway 32 which is parallel to the axis of the D-shaped hole 30 and which intersects both the D-shaped hole and the piercing pin receiving bore 23, 24.

The housing 12 is further provided with a threaded bore 34 which receives the threaded end of battery housing 16. A cavity 36 is formed in the housing 12 in line with the bore 34, the cavity being capable of receiving electrical circuit means. A stepped bore extends between the electrical circuit receiving cavity 36 and the piercing pin receiving bore 24, the stepped bore including a primer receiving cavity 38 and a fluid passageway 40 extending between the primer receiving cavity and the piercing pin receiving bore. The housing is further provided with a transverse aperture (no number) in which a pivot pin 42 may be force fit. The pivot pin in turn supports an L-shaped cam lever 44 provided with a cam portion 46 which may contact one end of a driving pin 48 which is disposed within the piercing pin receiving bore between the piercing pin 19 and the cam lever 44. A lanyard 50 is secured to an eye in the L-shaped cam lever 44 remote from the pivot pin 42 and a suitable handle 51 is secured to the other end of the lanyard for engagement by the hand of an operator. The handle 51, lanyard 50, lever 44 and driving pin 48 form the manually operated piercing pin shifting means.

The piercing pin 19 includes a conical end portion 52, and first and second cylindrical portions 53 and 55, respectively, which have progressively increasing diameters, there being a shoulder 54 between portions 53 and 55. The portion 53 is so sized that, when the pin 19 is shifted all the way to the left, there will be an interference fit between portion 53 and aperture 28 for reasons which will be brought out below. A groove 56 is provided on the surface of the conical portion 52 and the first cylindrical portion 53. A spring 57 is disposed about the first portion 54, one end of the spring bearing against wall 26 and the other end bearing against the shoulder 54 to normally bias the piercing pin 19 to the right into contact with the driving pin 48, which in turn forces the driving pin into contact with the L-shaped cam lever 44. As can be seen from FIG. 4, the portion 55 is provided with an annular groove for receiving an O-ring 58 which acts as a piston-like seal. Similarly the driving pin 48 is provided an O-ring 59 to the right hand side of a reduced portion of the driving pin. When the piercing pin 19 is shifted to the left, its movement may continue until the shoulder 54 between portions 53 and 55 abuts shoulder 25 between bore portions 23 and 24. When this happens, the spring 57 will not be fully compressed thereby permitting gas to flow from the bore 24 about the first portion 53, through the spring and through passageway 32.

The container 14 of pressurized gas is generally conventional and consists essentially of a metal container which is provided with a threaded end portion 60 which may be screwed into the threaded bore 20 in tight sealing relationship with packing ring 22. Disposed within the threaded end portion 60 is a pierceable closure 61 which may be ruptured when the piercing pin is shifted from its first position shown in FIG. 4 to a piercing position to the left of that position shown. When the closure is pierced, the gas within the container will be discharged past the leading end of the piercing pin and through the gas passageway formed by the keyway 32 into a stem received within the D-shaped opening.

In addition to the manual means 18 for shifting the piercing pin from the first to the second position, automatic means are also provided which will accomplish the same function when the device is placed in an electrically conductive fluid. The automatic piercing pin shifting means includes an electrically operated explosive device in the form of a primer 62, electrical circuit means, indicated generally at 63, and a source of power in the form of a battery 64. As the primer may be of the same type shown in U.S. Pat. No. 4,024,440, it will not be described in detail. The primer is disposed within the primer receiving cavity 38 and is interconnected with the electrical circuit means by a conductive pin 66. It should be noted that when the primer is ignited by the electrical circuit means, it is capable of causing the piercing pin to be shifted from its first position to a piercing position. Thus, the gas discharged from the primer will pass through the fluid passageway 40 and into the chamber within the piercing pin bore about the reduced portion of the driving pin 48. As the driving pin cannot be shifted away from the piercing pin when the gas enters this chamber, the piercing pin will be driven towards the container by the action of the rapidly expanding gas.

During automatic operation, piercing pin 19 is driven further than during manual operation and is not allowed to return to its original position. This is accomplished by retaining piercing pin 19 by means of the interference fit between aperture 28 and cylindrical portion 53 of piercing pin 19. This feature acts as a firing indicator to prevent reuse of an expended device. In addition to providing visual indication of automatic operation, the stuck forward piercing pin will pierce the pierceable closure 61 of the gas container 14, effectively thwarting any attempt to refurbish an expended device by installation of a charged gas container 14. Spring 57 is not fully compressed due to travel stop of piercing pin by shoulder 25, which is contacted by shoulder 54 during automatic operation. When operated manually, portion 53 of pin 19 will not be forced into aperture 28, thereby permitting reuse of the unit.

The electrical circuit means 63 is of the same type illustrated in U.S. Pat. No. 4,024,440 and is grounded to the housing 12 by means of a ground pin 68. The ground pin is received with an open ground pin receiving bore 70 and, as can be seen, the end of the ground pin is exposed. Thus, the ground pin can act as a first contact. The housing may additionally be provided with an exposed electrically conductive first contact which may be any portion of the housing free of a non-conductive coating, such as the pivot pin for the lanyard operated manual shifting means. In addition, the container 14 may act as the first contact as it is in electrical contact with the housing through its threaded coupling with the housing.

The battery 64, which is received within the battery housing 16, has spaced apart inner and outer terminals, the inner terminal 72 being the cathode and the outer terminal 74 being the anode. The housing is formed of an electrically insulating material such as polyethylene. Mounted within the battery housing 16 is a sensor contact assembly which includes an electrically conductive spring 75 and an electrically conductive plate 76. The housing is provided with a large diameter bore which receives the battery 64, and a smaller concentric bore 77 open to the exterior of the housing. The plate is force fit into the battery receiving bore until it abuts the shoulder adjacent the smaller bore 77.

The electrical circuit means, which is in line with the battery housing receiving bore 34, is provided with a contact 78 which, when the parts are assembled, is in contact with the inner terminal 72 of the battery. After the electrical circuit means has been placed within the cavity 36, it is insulated by a potting compound 80, the potting compound also serving to hold in place a cover 82, formed of an electrically conductive material, which is provided with an undercut 84 to insure that it will not work loose after the potting compound has hardened.

The cover 82 is press fit into cavity 36 after the electrical circuit means and potting compound have been placed therein and is in electrical contact with housing item 12. This feature combined with the angled configuration of the cover 82 provides electromagnetic interference protection for the circuit and primer. This qualifies the device for use in areas generally considered hazardous to electro-explosive assemblies. Qualification was assigned in accordance with MIL-STD-1385A Table I. (Preclusion of Ordinance Hazards In Electromagnetic Fields, General Requirements For.)

Due to the fully enclosed pressure tight design of the primer chamber and non-sparking firing circuit, the unit has also been qualified to MIL-STD-810C Method 511.1 Procedure IV (Explosive Atmosphere Test). This allows the device to be used in hazardous areas with explosive potential such as spilled fuel, chemicals, ordinance, etc.

When the device is placed in an electrically conductive fluid, a circuit is completed between the plate 76 and a contact portion of the device or container. This will in turn cause the electrical circuit means 63 to ignite the primer, causing the piercing pin to be driven into its piercing position, releasing the gas from container 14, which gas will now flow through passageway 32 into the stem received within the D-shaped opening.

While a preferred structure in which the principles of the present invention have been incorporated is shown and described above, it is to be understood that this invention is not to be limited to the particular details shown and described above, but that, in fact, widely differing means may be employed in the broader aspects of this invention.

What is claimed is:

1. A water activated pressurized gas release device comprising:

a one-piece housing formed of an electrically conductive material and provided with a longitudinally extending threaded bore, a piercing pin receiving bore coaxial with the threaded bore and open thereto, a transverse hole to one side of the piercing pin receiving bore, a gas passageway between the piercing pin receiving bore and the transverse hole, a cavity for receipt of electrical circuit means, and a stepped bore extending between the cavity and the piercing pin receiving bore;

an exposed electrically conductive first contact carried by said housing;

a container of pressurized gas having a threaded end portion disposed within the threaded bore and a pierceable closure disposed within said threaded end portion;

a piercing pin disposed within said piercing pin receiving bore and shiftable from a first position to a piercing position;

a primer disposed within the stepped bore and when ignited being capable of causing the piercing pin to be shifted from its first portion to its piercing position;

electrical circuit means received within the cavity and operatively associated with said primer and being capable of igniting the primer when said device is placed in an electrically conductive fluid, the electrical circuit means being in electrical contact with a portion of said electrically conductive housing and also having a battery contact;

a cover closing said cavity, said cover being provided with an undercut portion;

potting compound disposed about said electrical circuit means and engaging the undercut portion of the cover to firmly maintain the cover in place; and battery mounting means capable of maintaining one terminal of a battery in contact with said battery contact, the battery mounting means also being capable of establishing an electrical path to the other terminal of said battery when said device is placed in an electrically conductive fluid.

2. The water activated pressurized gas release device as set forth in claim 1 wherein said one-piece housing is further provided with a second threaded bore, the battery contact of the electrical circuit means being centrally located in the bottom of said bore, and wherein the battery mounting means includes a battery housing which is screwed into said second bore, said battery housing being formed of an electrically non-conductive material and further being provided with a sensor contact assembly capable of engaging the anode of the battery and biasing the cathode into contact with said battery contact, said sensor contact assembly including an electrically conductive portion in contact with the battery anode, said electrically conductive portion being exposed.

3. The water activated pressurized gas release device as set forth in claim 1 wherein the gas passageway between the piercing pin receiving bore and the transverse hole is a keyway extending from one side of the housing to the other side and parallel to the transverse hole and which intersects the transverse hole and the piercing pin receiving bore.

4. The water activated pressurized gas release device as set forth in claim 1 wherein the cover is continuous and is formed of an electrically conductive material, said cover being in electrical contact with the housing.

5. A pressurized gas release device comprising:

a housing provided with a longitudinally extending theaded bore, a piercing pin receiving bore coaxial with the threaded bore, said piercing pin bore having first and second concentric cylindrical portions, the diameter of the first portion being less than the diameter of the second portion, and there being a shoulder between the two portions, a wall between the threaded bore and the piercing pin receiving bore, the wall being provided with an aperture concentric with the piercing pin receiving bore and of a smaller diameter than the adjacent first portion of the piercing pin receiving bore, a transversely extending hole to one side of the piercing pin receiving bore, and a gas passageway extending between the piercing pin receiving bore and the transverse hole;

a container of pressurized gas having a threaded end portion disposed within the threaded bore and a pierceable closure disposed within said threaded end portion;

a piercing pin disposed within the piercing pin receiving bore, said piercing pin having a conical end portion, first and second cylindrical portions, and a shoulder between the first and second portions, the first portion being disposed adjacent the conical end and having a diameter of such a size that there will be an interference fit between the first portion and the aperture, and the second portion being adjacent the first portion and having a diameter of such a size that there is a clearance fit between the second portion of the pin and the second portion of the bore;

a compression spring disposed within the piercing pin receiving bore about the first cylindrical portion of the piercing pin, one end of the spring bearing against the wall and the other end bearing against the shoulder between the first and second portions of the piercing pin, said spring normally biasing the piercing pin to a first position; and shifting means capable of shifting said piercing pin from the first position to a piercing position to pierce said pierceable closure thereby permitting gas to flow from said container through a portion of said piercing pin receiving bore and said gas passageway to said transverse hole.

6. The pressurized gas release device as set forth in claim 5 wherein said shifting means may be manually operated, and when manually operated shifting the piercing pin to a piercing position wherein the first portion of the piercing pin does not enter into said aperture thereby permitting the device to be reused.

7. The pressurized gas release device as set forth in claim 5 wherein said shifting means is automatic means which will cause the piercing pin to be shifted to its piercing position when the device is placed in water, the automatic means including an explosure device which, when ignited, will shift the piercing pin to a piercing position wherein the first portion of the piercing pin will be jammed into said aperture thereby preventing the device from being reused, with the shoulder on the piercing pin contacting the shoulder within the piercing pin bore to prevent said compression spring from becoming fully compressed.

8. A water activated pressurized gas release device comprising:

a one-piece housing formed of an electrically conductive material, said housing being provided with a longitudinally extending threaded bore, a piercing pin receiving bore coaxial with the threaded bore and open thereto, a transverse hole to one side of the piercing pin receiving bore, a gas passageway between the piercing pin receiving bore and the transverse hole, a cavity for receipt of electrical circuit means, a stepped bore extending between the cavity and the piercing pin receiving bore, and a ground pin receiving bore extending from the cavity to the exterior surface of the housing, said exterior surface of the housing being provided with a non-conductive coating;

a piercing pin disposed within said piercing pin receiving bore and shiftable from a first position to a second position;

a container of pressurized gas having a threaded end portion disposed within the threaded bore and a pierceable closure disposed within said threaded end portion, said closure being pierced when the piercing pin is shifted from its first position to its second position;

a primer disposed within the stepped bore and being capable of causing the piercing pin to be shifted from its first position to its second position when the primer is ignited;

a battery having an anode and a cathode;

mounting means carried by the housing for mounting the battery with the cathode of the battery adjacent the cavity; and electrical circuit means received within the cavity and operatively associated with said primer, the electrical circuit means including a battery contact in contact with the cathode of the battery and a ground pin disposed within the ground pin receiving bore in electrical contact with the housing, one end of the ground pin being disposed adjacent the exterior surface of the housing, the electrical circuit means being capable of igniting the primer when said device is placed in an electrically conductive fluid, which fluid completes a circuit between the anode of the battery and the ground pin.

9. A water activated pressurized gas release device comprising:

a one-piece housing formed of an electrically conductive material and provided with a longitudinally extending threaded bore, a piercing pin receiving bore coaxial with the threaded bore and open thereto, a transverse hole to one side of the piercing pin receiving bore, a gas passageway between the piercing pin receiving bore and the transverse hole, a cavity, and a primer receiving bore extending between the cavity and the piercing pin receiving bore;

a container of pressurized gas having a threaded end portion disposed within the threaded bore and a pierceable closure disposed within said threaded end portion;

a piercing pin disposed within said piercing pin receiving bore between the primer receiving bore and the threaded bore and shiftable from a first position to a piercing position;

a primer disposed within the primer receiving bore and when ignited being capable of causing the piercing pin to be shifted from its first position to its piercing position;

electrical means capable of igniting the primer when the device is placed in an electrically conductive fluid, said electrical means including an electrical circuit received within the cavity and operatively associated with said primer;

a cover closing said cavity, said cover being formed of an electrically conductive material and having an undercut portion and in electrical contact with said housing whereby said electrical circuit is protected from electromagnetic interference; and potting compound disposed about said electrical circuit and engaging the cover at said undercut portion to firmly maintain the cover in place.

* * * * *